US010711776B2

(12) United States Patent
Bagagli et al.

(10) Patent No.: US 10,711,776 B2
(45) Date of Patent: Jul. 14, 2020

(54) RECIPROCATING COMPRESSORS HAVING TIMING VALVES AND RELATED METHODS

(71) Applicant: NUOVO PIGNONE S.p.A., Florence (IT)

(72) Inventors: Riccardo Bagagli, Florence (IT); Leonardo Tognarelli, Florence (IT)

(73) Assignee: NUOVO PIGNONE SPA, Florence (IT)

( * ) Notice: Subject to any disclaimer, the term of this patent is extended or adjusted under 35 U.S.C. 154(b) by 612 days.

(21) Appl. No.: 14/367,109

(22) PCT Filed: Dec. 13, 2012

(86) PCT No.: PCT/EP2012/075438
§ 371 (c)(1),
(2) Date: Jun. 19, 2014

(87) PCT Pub. No.: WO2013/092390
PCT Pub. Date: Jun. 27, 2013

(65) Prior Publication Data

US 2014/0377081 A1 Dec. 25, 2014

(30) Foreign Application Priority Data

Dec. 22, 2011 (IT) ..... CO2011A0071

(51) Int. Cl.
*F04B 49/03* (2006.01)
*F04B 35/01* (2006.01)
(Continued)

(52) U.S. Cl.
CPC ..... *F04B 49/03* (2013.01); *F04B 7/00* (2013.01); *F04B 35/01* (2013.01); *F04B 39/10* (2013.01); *F04B 49/16* (2013.01); *F04B 49/22* (2013.01)

(58) Field of Classification Search
CPC ..... F04B 1/1136; F04B 19/22; F04B 53/125; F04B 2205/15; F04B 49/22; F04B 49/24;
(Continued)

(56) References Cited

U.S. PATENT DOCUMENTS 1,938,472 A * 12/1933 Wainwright ..... F04B 49/03 417/298
2,655,306 A * 10/1953 Neff ..... F04B 45/04 417/28
(Continued)

FOREIGN PATENT DOCUMENTS

CN 102141025 A * 8/2011 ..... F04B 39/08
CN 201953605 U 8/2011
(Continued)

OTHER PUBLICATIONS

ProQueTran—CN 102141025.*
(Continued)

*Primary Examiner* — Christopher S Bobish
(74) *Attorney, Agent, or Firm* — Baker Hughes Patent Organization

(57) ABSTRACT

A reciprocating compressor for the oil and gas industry, the reciprocating compressor has a chamber, a timing valve, an actuator and a controller. A fluid entering the chamber via a suction valve is compressed inside the chamber, and evacuated from the chamber via a discharge valve. The timing valve is located between the chamber and a fluid volume at a relief pressure that is lower than a pressure in the chamber when the timing valve is opened. The actuator is configured to actuate the timing valve. The controller is configured to control the actuator such that to open the timing valve during an expansion phase of the compression cycle, and to close
(Continued)

the timing valve when the relief pressure becomes equal to the pressure in the chamber or when the suction valve is opened.

19 Claims, 5 Drawing Sheets

(51) Int. Cl.
*F04B 7/00* (2006.01)
*F04B 49/16* (2006.01)
*F04B 49/22* (2006.01)
*F04B 39/10* (2006.01)

(58) Field of Classification Search
CPC ..... F04B 53/10; F04B 49/16; F04B 49/03; F04B 35/01; F04B 7/00; F04B 39/10; F04C 14/24; F04C 2270/58; F04C 28/24; F04D 15/0005; F04D 15/02; F04D 27/009; F04D 27/0207
See application file for complete search history.

(56) References Cited

U.S. PATENT DOCUMENTS 3,366,062 A * 1/1968 Kelsey ..... F01L 31/00 417/446
3,523,745 A * 8/1970 Rich ..... F04B 15/08 417/284
3,972,652 A 8/1976 Minnicino
3,998,570 A * 12/1976 Jacobs ..... F04B 27/0878 417/274
4,373,870 A * 2/1983 Pandzik ..... F04B 49/24 417/269
4,480,965 A * 11/1984 Ishizuka ..... F04B 49/16 417/274
4,737,080 A * 4/1988 Owsley ..... F04B 49/243 251/25
5,056,036 A * 10/1991 Van Bork ..... F04B 49/065 417/14
5,711,582 A * 1/1998 Koike ..... B60T 8/341 303/11
6,289,932 B1 * 9/2001 Thackeray ..... F16K 39/024 137/630
6,607,366 B2 * 8/2003 Sperry ..... F04B 39/1013 137/522
8,826,680 B2 * 9/2014 Crane ..... F25B 49/022 62/228.3
2004/0213679 A1 * 10/2004 Cornwell ..... F04B 39/10 417/307
2009/0041588 A1 * 2/2009 Hunter ..... F04B 7/0076 417/27
2010/0256927 A1 * 10/2010 Hala ..... F04B 49/225 702/33
2010/0269799 A1 10/2010 Mellar
2011/0226342 A1 * 9/2011 Stein ..... F01B 15/06 137/2
2013/0091836 A1 * 4/2013 McBride ..... F01B 1/01 60/410

FOREIGN PATENT DOCUMENTS

FR 1030602 6/1953
FR 1030602 A * 6/1953 ..... F04B 25/005
FR 2507798 A1 12/1982
GB 1099893 A 1/1968
JP 4845915 A 6/1973
JP 5848993 U 4/1983
JP 58102787 U 7/1983
JP 08105387 A 4/1996
RU 2435065 C2 11/2011

OTHER PUBLICATIONS

ProQueTran—FR 1030602.*
Unofficial English translation of Chinese Office Action issued in connection with corresponding CN Application No. 201280063773.3 dated Sep. 14, 2015.
European Search Report and Written Opinion dated Aug. 13, 2012 which was issued in connection with Italian Patent Application No. CO2011A000071 which was filed on Dec. 22, 2011.
International Search Report and Written Opinion dated May 22, 2013 which was issued in connection with the PCT Patent Application No. PCT/EP12/075438 which was filed on Dec. 13, 2012.
Japanese Search Report issued in connection with corressponding JP Application No. 2012-209038 dated Jul. 29, 2016.
Unofficial English translation of Office Action issued in connection with corresponding JP Application No. JP 2012-209038 dated Oct. 21, 2016.
Unofficial English translation of Office Action issued in connection with corresponding MX Application No. MX/a/2014/007679 dated Aug. 19, 2016.
Unofficial English Translation of Russian Office Action issued in connection with corresponding RU Application No. 2014123159 dated Mar. 2, 2017.

* cited by examiner

RECIPROCATING COMPRESSORS HAVING TIMING VALVES AND RELATED METHODS

BACKGROUND

Technical Field

Embodiments of the subject matter disclosed herein generally relate to reciprocating compressors used in oil and gas industry, and, more particularly, to increasing a suction volume and mitigating the effect of the clearance volume by using a timing valve that is actuated to open during the expansion phase of the compression cycle.

Discussion of the Background

Compressors used in oil and gas industry, have to meet industry specific requirements that take into consideration, for example, that the compressed fluid is frequently corrosive and combustible. American Petroleum Institute (API), the organization setting the recognized industry standard for equipment used in oil and gas industry has issued a document, API618, listing a complete set of minimum requirements for reciprocating compressors.

The compressors may be classified as positive displacement compressors (e.g., reciprocating, screw, or vane compressors) or dynamic compressors (e.g., centrifugal or axial compressors). In the positive displacement compressors, the compression is achieved by trapping the gas and then reducing volume in which the gas is trapped. In the dynamic compressors, the compression is achieved by transforming the kinetic energy (e.g., of a rotating element) into pressure energy at a predetermined location inside the compressor.

FIG. 1 is an illustration of a conventional dual chamber reciprocating compressor 10 used in the oil and gas industry. Single chamber reciprocating compressors are less frequently used, but operate according to a similar compression cycle as the dual chamber reciprocating compressors.

In the reciprocating compressor 10, the fluid compression occurs in a cylinder 20. A fluid to be compressed (e.g., natural gas) is input into the cylinder 20 via an inlet 30 and through valves 32 and 34, and, after the compression, it is output via valves 42 and 44 and then an outlet 40. The compression is a cyclical process in which the fluid is compressed due to a movement of the piston 50 along the longitudinal axis of the cylinder 20, between a head end 26 and a crank end 28. In fact, the piston 50 divides the cylinder 20 in two chambers 22 and 24 operating in different phases of the compression cycle, the volume of chamber 22 being at its lowest value when the volume of the chamber 24 is at its highest value and vice-versa.

Suction valves 32 and 34 open at different times to allow the fluid that is going to be compressed from the inlet 30 into the chambers 22 and 24, respectively. Discharge valves 42 and 44 open to allow the fluid that has been compressed to be output from the chambers 22 and 24, respectively, via the outlet 40. The piston 50 moves due to energy transmitted from a crankshaft 60 via a crosshead 70 and a piston rod 80. Conventionally, the suction and the discharge valves (e.g., 32, 34, 42, and 44) used in a reciprocating compressor are automatic valves that are switched between a close state and an open state due to a differential pressure across the valve.

An ideal compression cycle (graphically illustrated in FIG. 2 by tracking evolution of pressure versus volume) includes at least four phases: expansion, suction, compression and discharge. When the compressed fluid is evacuated from a chamber at the end of a compression cycle, a small amount of fluid at the delivery pressure $P_1$ remains trapped in a clearance volume $V_1$ (i.e., the minimum volume of the chamber). During the expansion phase 1 and the suction phase 2 of the compression cycle, the piston moves to increase the volume of the chamber. At the beginning of the expansion phase 1, the delivery valve closes (the suction valve remaining closed), and then, the pressure of the trapped fluid drops since the volume of the chamber available to the fluid increases. The suction phase of the compression cycle begins when the pressure inside the chamber becomes equal to the suction pressure $P_2$, triggering the suction valve to open at volume $V_2$. During the suction phase 2, the chamber volume and the amount of fluid to be compressed (at the pressure $P_2$) increase until a maxim volume of the chamber $V_3$ is reached.

During the compression and discharge phases of the compression cycle, the piston moves in a direction opposite to the direction of motion during the expansion and suction phases, to decrease the volume of the chamber. During the compression 3 phase both the suction and the delivery valves are closed (i.e. the fluid does not enter or exits the cylinder), the pressure of the fluid in the chamber increasing (from the suction pressure $P_2$ to the delivery pressure $P_1$) because the volume of the chamber decreases to $V_4$. The delivery phase 4 of the compression cycle begins when the pressure inside the chamber becomes equal to the delivery pressure $P_1$, triggering the delivery valve to open. During the delivery phase 4 the fluid at the delivery pressure $P_1$ is evacuated from the chamber until the minimum (clearance) volume $V_1$ of the chamber is reached.

One measure of the efficiency of the compressor is the volumetric efficiency which is a ratio between the volume $V_3$-$V_2$ of the chamber swept by the piston of the reciprocating compressor during the suction phase and the total volume $V_3$-$V_1$ swept by the piston during the compression cycle. One can consider that the purpose of a compressor is to deliver as much compressed fluid as possible. The larger the volumetric efficiency the more fluid is compressed in each compression cycle. One important source of inefficiency in the reciprocating compressor is due to the clearance volume, which is a volume of compressed gas which is not delivered from the chamber during to the delivery phase.

If a suction valve would open early, before the pressure inside the chamber drops due to the gas expansion, to the suction pressure $P_1$, then some of the compressed air remaining in the chamber would exit the chamber. However, the force necessary to open the suction valve is large, proportional with the area of the valve and a pressure difference across the suction valve (i.e., the pressure difference between the pressure inside the chamber and the suction pressure). Such a large force would require a large actuator which would also have a short actuation time. At a practical level, opening the suction valve early is not currently feasible.

Accordingly, it would be desirable to provide methods and devices useable in reciprocating compressors for the oil and gas industry that have an effect similar to early opening of the suction valve.

SUMMARY

Some of the embodiments relate to a timing valve opened during an expansion phase of a chamber in a reciprocating compressor used in oil and gas industry. The presence and operation of the timing valve results in an increased suction volume (and, therefore, volumetric efficiency) and mitigates the effect of the clearance volume.

According to one exemplary embodiment, a reciprocating compressor has a chamber, a timing valve, an actuator and a controller. A fluid entering the chamber via a suction valve is compressed inside the chamber, and the compressed fluid is evacuated from the chamber via a discharge valve. The timing valve is located between the chamber and a fluid volume at a relief pressure that is lower than a pressure in the chamber when the timing valve is opened. The actuator is configured to actuate the timing valve. The controller is configured to control the actuator such that to open the timing valve during an expansion phase of the compression cycle, and to close the timing valve when the relief pressure becomes equal to the pressure in the chamber or when the suction valve is opened.

According to another exemplary embodiment, a method of improving a volumetric efficiency of a reciprocating compressor is provided. The method includes providing a timing valve located between a chamber of the reciprocating compressor and a volume of fluid at a relief pressure, and controlling the timing valve to opened during an expansion phase of a compression cycle, while the relief pressure is smaller than a pressure inside the chamber. The timing valve has a flow area smaller than a flow area of a suction valve of the reciprocating compressor.

According to another exemplary embodiment, a method of retrofitting a compressor to evacuate fluid from a chamber during an expansion phase of a compression cycle is provided. The method includes (1) providing a timing valve located between the chamber and a volume of fluid at a relief pressure, (2) mounting an actuator configured to actuate the timing valve, and (3) connecting a controller to the actuator. The controller is configured to control the actuator such the timing valve to be opened during the expansion phase of the compression cycle, while a pressure in the chamber is larger than the relief pressure.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of reciprocating compressors used in oil and gas industry. However, the embodiments to be discussed next are not limited to this equipment, but may be applied to other equipment.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

In some embodiments described below, the volumetric efficiency of a reciprocating compressor is improved by using a timing valve opened during an expansion phase of a compressing cycle, to allow a fluid to exit the chamber of the reciprocating compressor. The timing valve is connected to a fluid volume having a relief pressure that is lower than the pressure of the fluid in the chamber.

Figure 3:
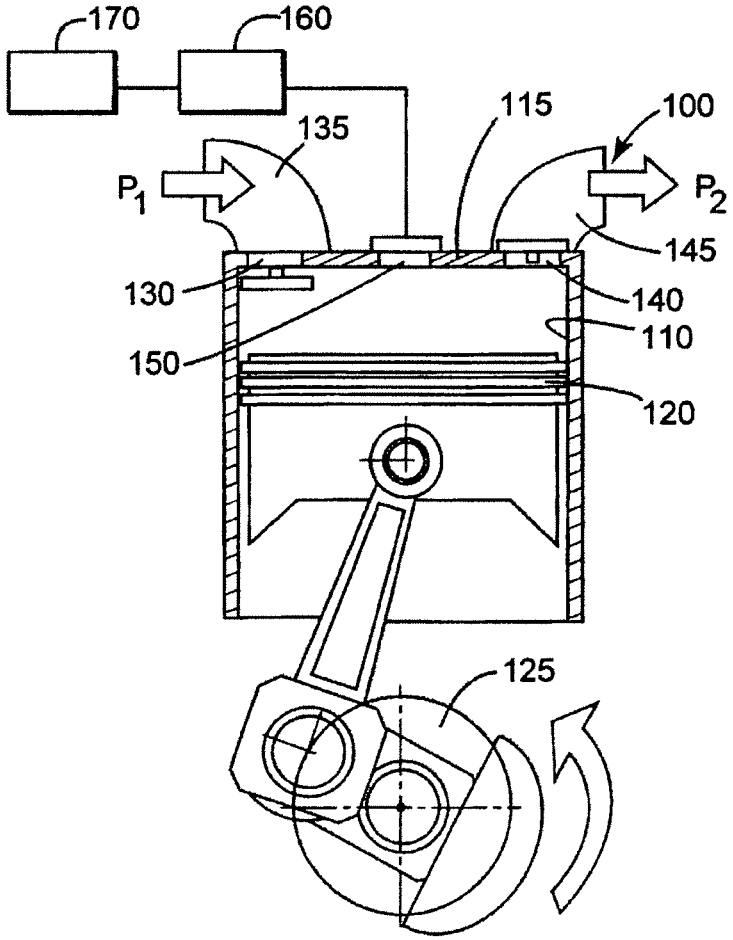
FIG. 3 is schematic diagram of a reciprocating compressor, according to an exemplary embodiment.

FIG. 3, illustrates a reciprocating compressor 100, according to an exemplary embodiment. The reciprocating compressor 100 has a single chamber 110. However, the current inventive concept is also applicable to dual chamber reciprocating compressors.

A piston 120 performs a reciprocating motion to compress a fluid inside the chamber 110. The piston 120 receives the reciprocating motion from a crank shaft 125. The piston 120 moves towards and away from a head end 115 of the chamber 110. In other words, the head end 115 is perpendicular to a direction along which the piston 120 moves.

The fluid to be compressed enters the chamber 110 via a suction valve 130, from a suction duct 135. After being compressed, the fluid is evacuated from the chamber 110 via a discharge valve 140 towards a discharge duct 145. In the illustrated embodiment, the suction valve 130 and the discharge valve 145 are located on the head end 115 of the chamber 110.

A timing valve 150 is configured to allow the fluid to exit the chamber during an expansion phase of a compression cycle in the chamber 110. The timing valve 150 is actuated by an actuator 160. The timing valve 150 is located between the chamber 110 and a volume of fluid having a relief pressure that is smaller than the pressure in the chamber 110. In FIG. 3, the timing valve 150 is connected to the suction valve 135, but in other embodiments, the timing valves may be connected differently to a separate volume of fluid having a relief pressure that is lower than a pressure in the chamber 110 while the timing valve 150 is opened.

The timing valve 150 is an actuated valve. The force necessary to open the timing valve is proportional with the difference of pressure between opposite sides of the timing valve 150 and the flow area of the timing valve 150. In order to generate a large force, a big (volume-wise) actuator would be necessary. Therefore, the flow area of the timing valve 150 is smaller (even substantially smaller) than the flow area of the suction valve 130, such as to be possible to open the timing valve 150 using a small (volume-wise) actuator 160.

The controller 170 controls the actuator 160 to open the timing valve 150 during the expansion phase of the compression cycle. The smaller the force that the actuator 160 has to provide to open the valve 150 the earlier the timing valve 150 can be opened. The controller 170 controls the actuator 160 to close the timing valve 150 after the pressure in the chamber 110 becomes equal to the relief pressure or after the suction valve 130 opens. The timing valve 150 has to be closed before the end of the suction phase of the compression cycle. Since in the embodiment illustrated in FIG. 3, the timing valve 150 is connected to the suction duct 135, the relief pressure is the suction pressure $P_2$.

The suction valve 130 may be an automatic valve opening when pressure in the chamber is substantially equal to a pressure of the fluid in a suction duct, the suction valve being located between the chamber and the suction duct. However, the suction valve may be also an actuated valve and its actuator (not shown) may be controlled by the controller 170.

Figure 1:
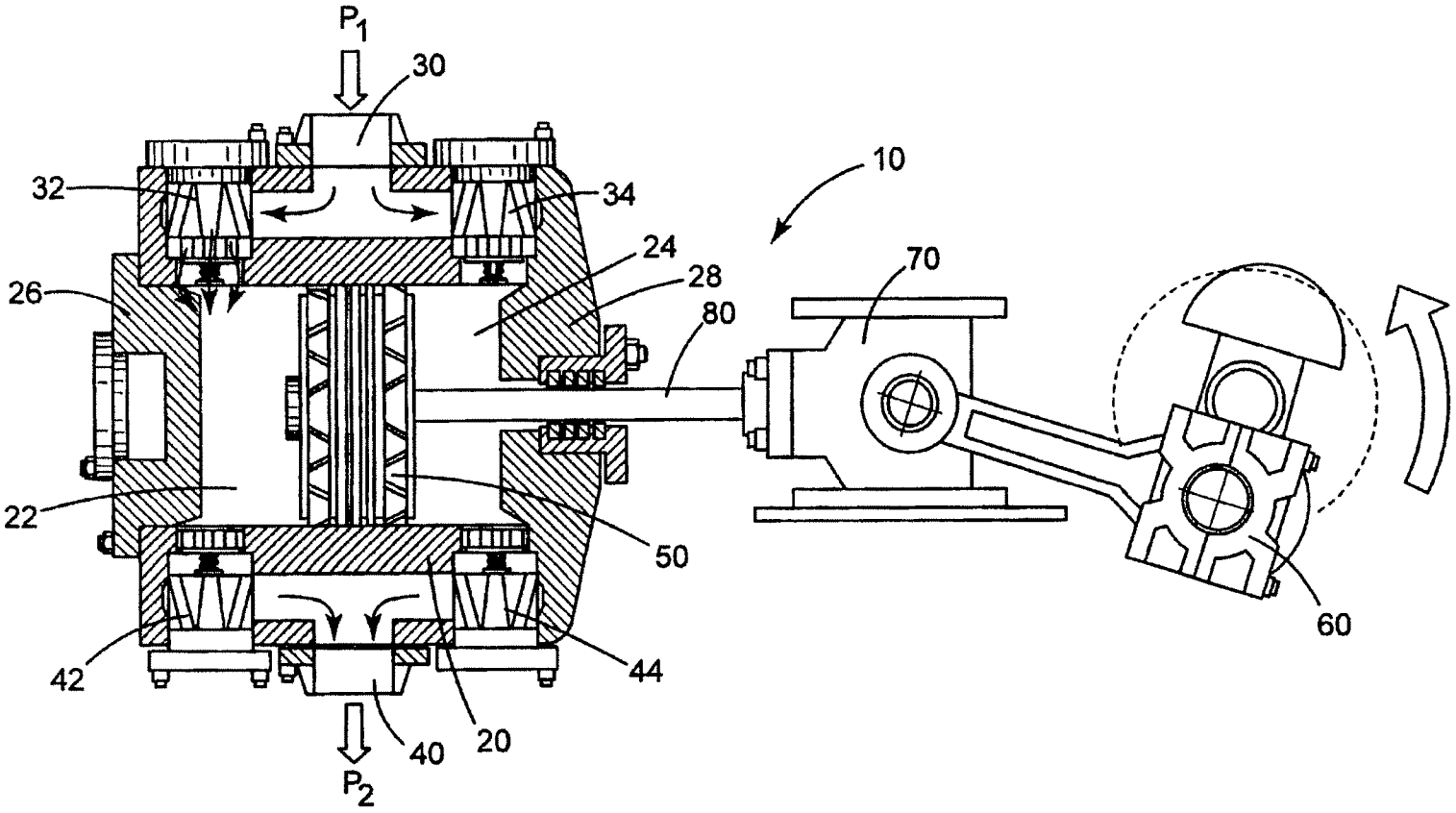
Figure 1 Background Art
FIG. 1 is a schematic diagram of a conventional dual chamber reciprocating compressor.
Figure 2:
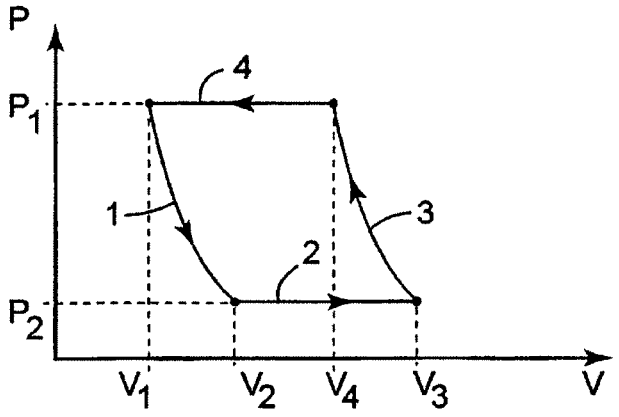
FIG. 2 is a pressure versus volume graphic illustrating an ideal compression cycle.
Figure 4:
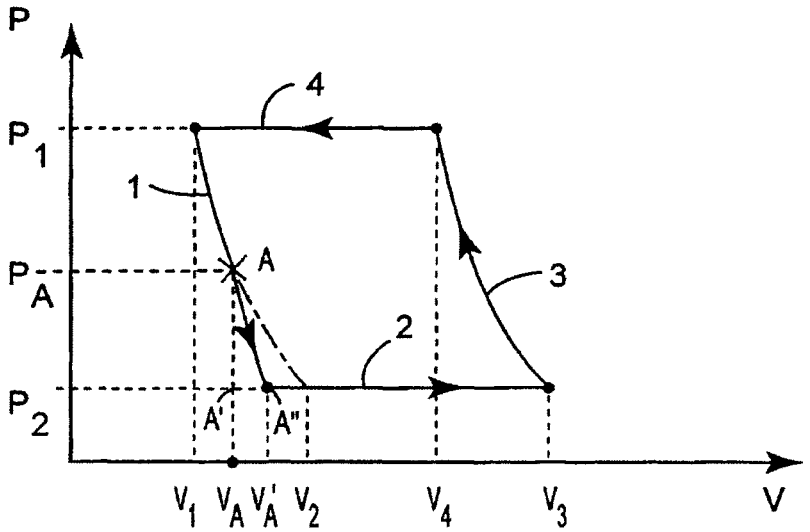
FIG. 4 is a pressure versus volume graphic illustrating the effect of the timing valve, according to an exemplary embodiment.

The pressure versus volume graph in FIG. 4 illustrates the effect of using the timing valve 150. If the timing valve were not used, as illustrated in FIG. 2, the expansion phase 1 is a polytropic process $pV^n$=constant (where ideally $n=\gamma$ for adiabatic process), ending when the pressure in the chamber equals the suction pressure $P_2$ triggering the suction valve 130 to open. The timing valve 150 is opened when pressure in the chamber is $P_A$ (point A on the graph) due to a force generated by the actuator 160. If the flow area of the timing valve 150 was large or the piston 120 was not continuing to move after the timing valve is opened (i.e., the volume of the chamber 110 would remain constant), an isochoric process A-A' would have taken place in the chamber 110. (i.e., the pressure would drop for a constant volume $V_A$ illustrated as a vertical line in the graph).

However, in reality, the flow area of the timing valve 150 is small and the piston 120 continues to move after the timing valve is opened. The pressure inside the chamber 110 drops due to the motion of the piston 120 increasing the volume of the chamber 110 and because fluid exits the chamber 110 through the timing valve 150. The line A-A" in the graph represents the pressure dependence of volume after the opening of the timing valve 150. The line A-A" is located between curve A-($P_2$, $V_2$) corresponding to the expansion without opening the timing valve, and the vertical line A-A' corresponding to an isochoric process. This expansion that takes place while the timing valve 150 is opened leads faster (compared to when the timing valve is not opened) to a pressure inside the chamber 110 equal to the suction pressure $P_1$. Additionally, the volume $V'_A$ at the end of the expansion while using the timing valve is smaller than the volume $V_2$ at the end of the expansion phase without using the timing valve. Since $V'_A<V_2$, the volumetric efficiency (which is a ratio between the volume of the chamber swept by the piston of the reciprocating compressor during the suction phase and the total volume swept by the piston during the compression cycle) increases.

Figure 5:
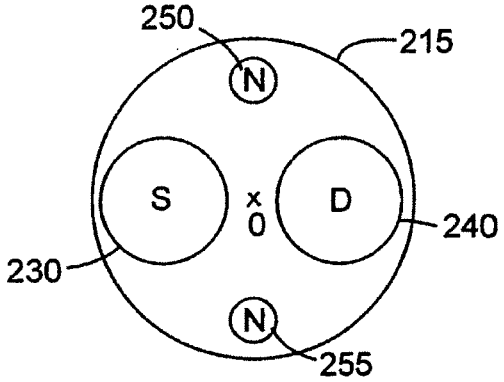
FIG. 5 illustrates an arrangement of valves on a head end of a reciprocating compressor, according to an exemplary embodiment.

In some embodiments, plural timing valves are used in a reciprocating compressor. For example, FIG. 5 illustrates an arrangement of timing valves on the head end 215 of a single or a dual reciprocating compressor. In this arrangement, two timing valves 250 and 255 are arranged substantially symmetrical relative to a middle O of the head end 215. The suction valve 230 and the discharge valve 240 are also arranged substantially symmetrical relative to the middle O of the head end 215.

Figure 6:
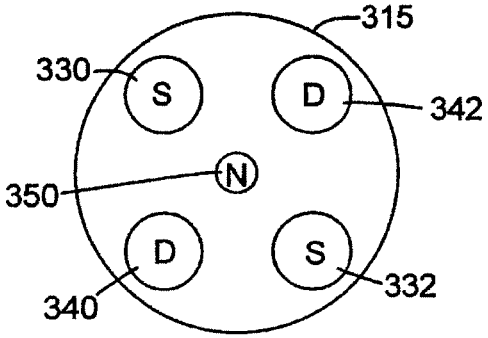
FIG. 6 illustrates an arrangement of valves on a head end of a dual chamber reciprocating compressor, according to an exemplary embodiment.

The reciprocating compressor 100 illustrated in FIG. 3 is a reciprocating compressor having a single chamber. However, the same inventive concept may be applied to a dual chamber reciprocating compressor having a cylinder divided in two chambers by a piston. A timing valve may be provided for one or both chambers of a dual chamber reciprocating compressor. Two suction valves 330 and 332, two discharge valves 340 and 342 and a timing valve 350 may all be arranged on a head end 315 of a dual chamber reciprocating compressor as illustrated in FIG. 6.

Figure 7:
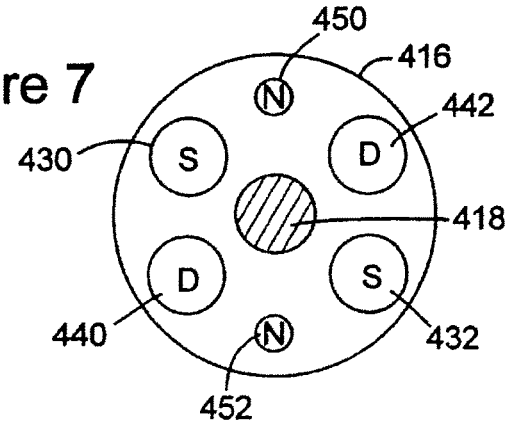
FIG. 7 illustrates an arrangement of valves on a crank end of a dual chamber reciprocating compressor, according to an exemplary embodiment.

The valves may be arranged on a head end and/or on a crank end of a dual chamber reciprocating compressor. Two suction valves, 430 and 432, two discharge valves, 440 and 442, and two timing valves, 450 and 452, may be arranged on a crank end 416 of a dual chamber reciprocating compressor as illustrated in FIG. 7. The head end and the crank end of the dual chamber reciprocating compressor are substantially perpendicular on a direction along which the piston moves. The crank end 416 has an additional opening 418 through which the piston receives the reciprocating motion (e.g., from a crankshaft via a rod and a crosshead).

However, in yet another embodiment, (1) the suction valve, the discharge valve, and the timing valve of one chamber may be located on a head end of the cylinder of a dual reciprocating compressor, and (2) the suction valve, the discharge valve, and the timing valve of the other chamber may be located on the crank end of the cylinder.

Figure 8:
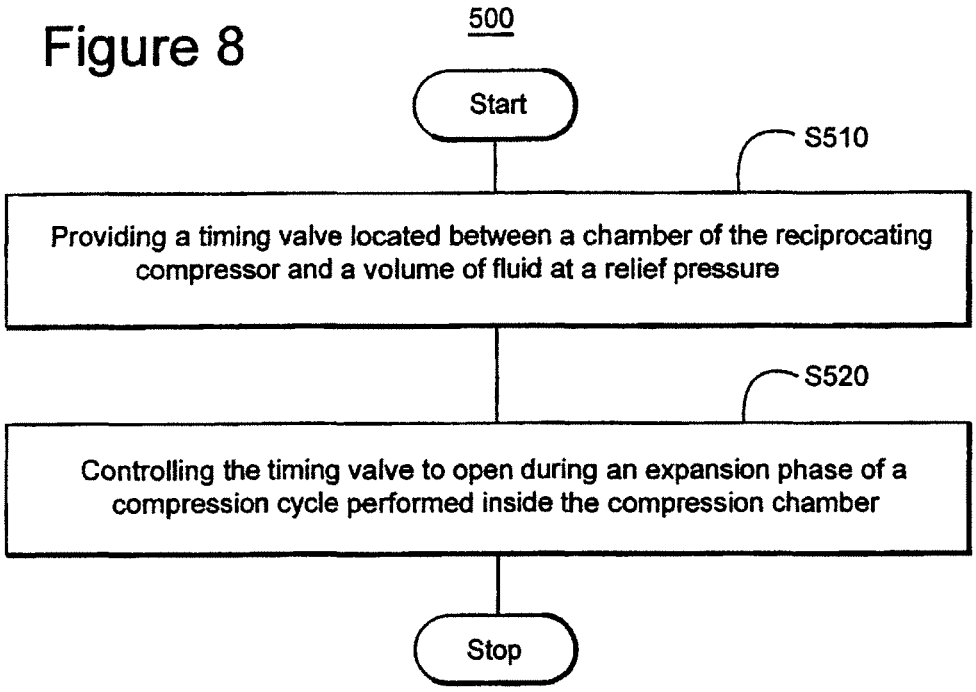
FIG. 8 is a flow chart of a method of improving a volumetric efficiency of a reciprocating compressor, according to an exemplary embodiment.

A flow diagram of a method 500 of improving a volumetric efficiency of a reciprocating compressor is illustrated in FIG. 8. The method 500 includes providing a timing valve located between a chamber of the reciprocating compressor and a volume of fluid at a relief pressure, at S510. Further, the method 500 includes controlling the timing valve to be opened during an expansion phase of a compression cycle performed inside the chamber, while the relief pressure is smaller than a pressure inside the chamber, at S520. The timing valve has a flow area smaller than a flow area of a suction valve of the reciprocating compressor.

Figure 9:
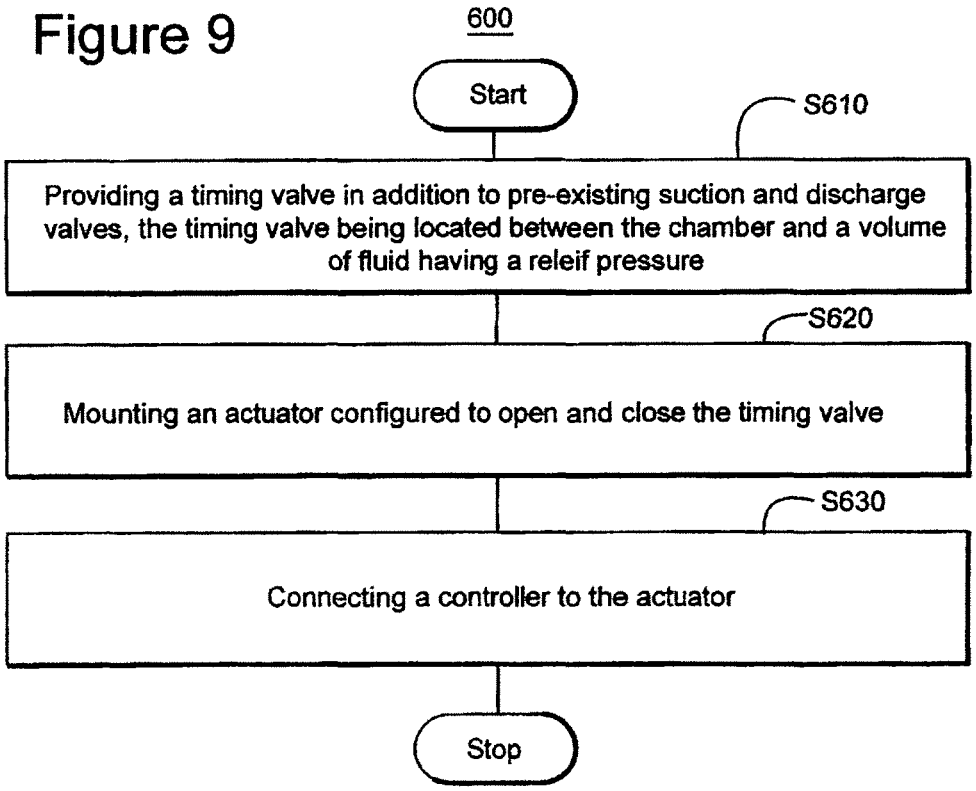
FIG. 9 is a flow diagram of a method of retrofitting a reciprocating compressor to evacuate fluid from a chamber during an expansion phase of a compression cycle, according to another exemplary embodiment.

Existing reciprocating compressors may be retrofitted to improve their volumetric efficiency. A flow diagram of a method 600 of retrofitting a reciprocating compressor to evacuate fluid from a chamber during an expansion phase of a compression cycle is illustrated in FIG. 9. The method 600 includes providing a timing valve on the chamber, the timing valve being located between the chamber and a volume of fluid at a relief pressure, at S610. The method 600 further includes mounting an actuator configured to actuate the timing valve, at S620, and connecting a controller to the actuator, at S630. The controller is configured to control the actuator such that the timing valve to be opened during the expansion phase of the compression cycle, while a pressure in the chamber is larger than the relief pressure. The timing valve may be is connected to the suction duct to which the suction valve of the reciprocating compressor is also connected. The flow area of the timing valve may be substantially smaller than the area of a suction valve of the chamber.

The disclosed exemplary embodiments provide methods and devices used in reciprocating compressors to increase a suction volume (and, thus, the volumetric efficiency) and to mitigate the effect of the clearance volume by using a timing valve that is actuated to open during the expansion phase of the compression cycle. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A reciprocating compressor, comprising:

a chamber inside which a fluid entering the chamber via a suction valve is compressed, and the compressed fluid is evacuated from the chamber via a discharge valve;

a timing valve located between the chamber and a volume of fluid having a relief pressure that is lower than a pressure inside the chamber when the timing valve is opened;

an actuator configured to actuate the timing valve; and a controller configured to control the actuator to open the timing valve during an expansion phase of a compression cycle and close the timing valve when the relief pressure becomes equal to the pressure inside the chamber.

2. The reciprocating compressor of claim 1, wherein the timing valve has a flow area smaller than a flow area of the suction valve.

3. The reciprocating compressor of claim 1, wherein the timing valve is located on a head end of the chamber, the head end being substantially perpendicular on a direction along which a piston moves.

4. The reciprocating compressor of claim 3, wherein the timing valve has a flow area smaller than a flow area of the suction valve.

5. The reciprocating compressor of claim 1, wherein the chamber comprises another chamber inside which a fluid entering the other chamber via another suction valve is compressed, and the compressed fluid is evacuated from the other chamber via another discharge valve, the reciprocating compressor further comprising:

another timing valve configured to allow the fluid to exit the other chamber during the expansion phase of a compression cycle, the timing valve and the other timing valve having areas substantially smaller than an area of the suction valve; and another actuator configured to open the other timing valve, wherein the controller is further configured to control the other actuator to open the other timing valve during the expansion phase of a compression cycle in the other chamber thereby allowing the fluid to exit thereof and close the other timing valve when the relief pressure becomes equal to the pressure in the other chamber.

6. The reciprocating compressor of claim 5, wherein at least one of the timing valves and at least one of the suction valves are connected between the respective chambers and a suction duct through which the fluid to be compressed is supplied to the chamber.

7. The reciprocating compressor of claim 5, wherein at least one of following conditions is met:

the timing valve and the other timing valve have substantially equal areas the controller is configured to control the actuator and the other actuator to open the timing valve and the other timing valve at substantially the same moment, and the suction valve and the other suction valve, the discharge valve and the other discharge valve, and the timing valve and the other timing valve are located on a head end of the chamber, the head end being substantially perpendicular on a direction along which piston moves.

8. The reciprocating compressor of claim 7, wherein at least one of the timing valves and at least one of the suction valves are connected between the respective chambers and a suction duct through which the fluid to be compressed is supplied to the chamber.

9. The reciprocating compressor of claim 1, wherein the timing valve and the suction valve are connected between the chamber and a suction duct through which the fluid to be compressed is supplied to the chamber.

10. The reciprocating compressor of claim 1, wherein the reciprocating compressor is a dual reciprocating compressor comprising a cylinder divided in two chambers by a piston, the two chambers comprising the chamber and another chamber, and are configured to increase pressure of the fluid entering the other chamber via another suction valve and being evacuated from the other chamber via another discharge valve, and the suction valve, the other suction valve, the discharge valve, the other discharge valve and the timing valve are located on a head end of the cylinder, the head end being substantially perpendicular on a direction along which the piston moves.

11. The reciprocating compressor of claim 10, wherein the timing valve has a flow area smaller than a flow area of the suction valve.

12. The reciprocating compressor of claim 10, wherein the timing valve and the suction valve are connected between the chamber and a suction duct through which the fluid to be compressed is supplied to the chamber.

13. The reciprocating compressor of claim 12, wherein the timing valve has a flow area smaller than a flow area of the suction valve.

14. The reciprocating compressor of claim 1, wherein the reciprocating compressor is a dual reciprocating compressor the reciprocating compressor further comprising:

a cylinder divided in two chambers by a piston, the two chambers comprising the chamber and another chamber, and are configured to increase pressure of the fluid entering the other chamber via another suction valve and being evacuated from the other chamber via another discharge valve, and another timing valve configured to allow the fluid to exit the other chamber during an expansion phase of a compression cycle in the other chamber, wherein:

the suction valve, the other suction valve; the discharge valve, the other discharge valve, the timing valve and the other timing valve are located on a head end or on a crank end of the cylinder, or the suction valve; the discharge valve, and the timing valve are located on a head end of the cylinder, and the other suction valve, the other discharge valve, and the other timing valve are located on the crank end of the cylinder.

15. The reciprocating compressor of claim 14, wherein the timing valve has a flow area smaller than a flow area of the suction valve.

16. The reciprocating compressor of claim 14, wherein the timing valve and the suction valve are connected between the chamber and a suction duct through which the fluid to be compressed is supplied to the chamber.

17. The reciprocating compressor of claim 16, wherein the timing valve has a flow area smaller than a flow area of the suction valve.

18. The reciprocating compressor of claim 1, wherein the controller is configured to control the actuator to open the timing valve during an expansion phase of a compression cycle while a pressure in the chamber is larger than the relief pressure.

19. A method of retrofitting a compressor to evacuate a fluid from a compression chamber of the compressor during an expansion phase of a compression cycle, the method comprising:

locating a timing valve between the chamber and a volume of fluid at a relief pressure; mounting an actuator configured to actuate the timing valve; and connecting a controller to the actuator, the controller being configured to control the actuator such that the timing valve is opened during the expansion phase of the compression cycle, while a pressure in the chamber is larger than the relief pressure, and closed when the relief pressure becomes equal to the pressure inside the chamber.

* * * * *